US009561935B2

(12) United States Patent
Perälä

(10) Patent No.: US 9,561,935 B2
(45) Date of Patent: Feb. 7, 2017

(54) METHOD AND ELEVATOR ARRANGEMENT

(71) Applicant: KONE Corporation, Helsinki (FI)

(72) Inventor: Jussi Perälä, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 206 days.

(21) Appl. No.: 14/312,449

(22) Filed: Jun. 23, 2014

(65) Prior Publication Data

US 2014/0367205 A1 Dec. 18, 2014

Related U.S. Application Data

(63) Continuation of application No. PCT/FI2013/050040, filed on Jan. 15, 2013.

(30) Foreign Application Priority Data

Jan. 16, 2012 (FI) ..... 20125045

(51) Int. Cl.
*B66B 11/00* (2006.01)
*B66B 19/00* (2006.01)
*B66B 9/00* (2006.01)

(52) U.S. Cl.
CPC ..... *B66B 11/0005* (2013.01); *B66B 9/00* (2013.01); *B66B 11/008* (2013.01); *B66B 19/00* (2013.01); *B66B 19/002* (2013.01)

(58) Field of Classification Search
CPC .... B66B 11/0005; B66B 19/002; B66B 19/02; B66B 19/00
See application file for complete search history.

(56) References Cited

U.S. PATENT DOCUMENTS 3,298,462 A * 1/1967 Morris ..... B66B 9/187 182/178.1
3,519,101 A * 7/1970 Sieffert ..... B66B 9/187 187/256

(Continued)

FOREIGN PATENT DOCUMENTS

CN 200964317 Y 10/2007
CN 201999604 U 10/2011

(Continued)

*Primary Examiner* — Minh Truong
(74) *Attorney, Agent, or Firm* — Birch, Stewart, Kolasch & Birch, LLP

(57) ABSTRACT

A method in the manufacture of an elevator, in which is formed an elevator arrangement, which includes an elevator hoistway, at least one elevator unit to be moved in the elevator hoistway, said unit(s) including at least an elevator car, a movable supporting structure in the elevator hoistway above the elevator car, roping suspended from the supporting structure for supporting the aforementioned at least one elevator unit to be moved, in which method the following steps are performed: a) the elevator car is used to transport passengers and/or freight, after which b) the supporting structure is lifted in the elevator hoistway, after which c) the elevator car is used to transport passengers and/or freight. In the method, between steps a) and c), additionally a step x) is performed, in which the section of the roping is lifted, separately from the lifting of the supporting structure, higher up in the elevator hoistway. An elevator arrangement includes a movable diverting pulley separate from the supporting structure, supported by which diverting pulley the section of roping is arranged to be suspended.

13 Claims, 2 Drawing Sheets

(56) References Cited

U.S. PATENT DOCUMENTS

| | | | | |
|---|---|---|---|---|
| 5,033,586 | A * | 7/1991 | Richards | B66B 9/187 187/259 |
| 7,635,049 | B2 * | 12/2009 | Van Der Meijden | B66B 19/002 187/401 |
| 2007/0181381 | A1 * | 8/2007 | Jungbauer | B66B 9/187 187/401 |
| 2008/0308362 | A1 * | 12/2008 | Tucker | B66B 19/00 187/414 |
| 2011/0113720 | A1 * | 5/2011 | Peacock | B66B 19/00 52/741.1 |
| 2012/0291395 | A1 * | 11/2012 | Plathin | B66B 19/02 52/741.1 |
| 2013/0233655 | A1 * | 9/2013 | Peacock | B66B 19/00 187/414 |
| 2014/0000987 | A1 * | 1/2014 | Peacock | B66B 19/00 187/414 |
| 2014/0231179 | A1 * | 8/2014 | Alasentie | B66B 11/0045 187/251 |
| 2015/0034425 | A1 * | 2/2015 | Ratia | B66B 7/06 187/249 |

FOREIGN PATENT DOCUMENTS

| | | | |
|---|---|---|---|
| CN | 102341336 | A | 2/2012 |
| CN | 102762484 | A | 10/2012 |
| JP | 57-42483 | A | 3/1982 |
| WO | WO 2010/100319 | A1 | 9/2010 |
| WO | WO 2011/080387 | A1 | 7/2011 |

* cited by examiner

METHOD AND ELEVATOR ARRANGEMENT

CROSS REFERENCE TO RELATED APPLICATIONS

This non-provisional application is a Continuation of International Application No. PCT/FI2013/050040 filed on Jan. 15, 2013, which claims priority to Finnish Patent Application No. 20125045 filed in Finland on Jan. 16, 2012. The entire contents of all of the above applications are hereby incorporated by reference.

FIELD OF THE INVENTION

The object of the invention is a method in the manufacture of an elevator and an elevator arrangement, which elevator is preferably an elevator and applicable to passenger transport and/or freight transport, and in which method and in which elevator arrangement the elevator is/can be taken into service use already during its construction-time.

BACKGROUND OF THE INVENTION

In connection with so-called jump-lifts, an elevator is taken into use already before the full length of the elevator hoistway has been completed. The elevator car moving in the bottom part of the elevator hoistway is supported and moved during the construction-time use suspended on hoisting ropes that are supported by a supporting structure in the elevator hoistway, which ropes are moved with a hoisting machine. The top part of the elevator hoistway above the supporting structure is constructed at the same time as an elevator car moving in the already completed bottom part of the elevator hoistway serves people on the lower floors of the building. The hoisting machine can be supported e.g. on the supporting structure. When the part of the elevator hoistway under construction above the supporting platform has reached a sufficient stage of readiness, it can be taken into use. In this case a lift (a so-called jump-lift) is performed, wherein the supporting platform is raised to a higher position in the elevator hoistway, thus extending the service range of the elevator car upwards. A worksite crane in use in the construction of the building can, for example, be used for the lifting. Alternatively, the supporting structure could be shifted with a hoist, which is supported on a support structure to be arranged in the hoistway above the machine room platform. When the elevator hoistway has reached its final height, the elevator is left permanently in its position, possibly however first performing some conversion procedures, e.g. by removing the elements required for jump-lifts, possibly by replacing the roping and/or by changing its route. One solution according to prior art is described in publication WO 2010100319.

One problem in solutions according to prior art has been the large weight of the structures to be hoisted in lifting the supporting structure. More particularly the roping hanging from the supporting structure is supported during a lift by the hoist moving the supporting structure. The hoist itself and the hoisting arrangement generally must be dimensioned to be heavy-duty. Likewise the support points for the structures, more particularly for the hoisting arrangement of the supporting structure, but also for supporting the supporting structure in its position, have been difficult to arrange. It has been noticed that the difficulty of finding support points that are sufficiently stable and durable is one limiting the maximum height to which a jump-lift can, with a reasonable work input, reach. A worksite crane must sometimes be used for shifting the machine room platform, because the aforementioned problems make other solutions so awkward. Another problem has been, generally speaking, the demanding installation environment, which has set numerous practical challenges, which are connected to the smooth running and safety of the installation and to the durability of installation structures. These are, inter alia, the space usage and complexity of the hoisting arrangement for the machine room platform, the center of mass and stability of the machine room platform during the lifting and while it is stationary in position, the center of mass and stability of the support arrangement to be used for the lifting during the lifting and while in position, the layout producing a suitable balance of the support locking mechanism, the cramped layout of the machine room platform, suitable hoisting devices, the dimensioning of the hoisting machine for the final lifting height, routing of the ropes with adequate run clearances, correct configuration of the rope length, the need for safe and spacious working space and position. These numerous variables that must be taken into account affect each other directly or indirectly and their overall effect is that the structure easily becomes complex and heavily built, and requires a lot of space. Taking these challenges into account, there has been a need to further simplify the supporting structure to be lifted in a jump lift and to reduce the weight to be lifted in a jump lift. Likewise, there has been a need to further develop the safety and speed of the method.

BRIEF DESCRIPTION OF THE INVENTION

An aim of the invention is to solve the aforementioned problems of prior-art solutions. A further aim is to solve the problems disclosed in the description of the invention below. The aim is thus to produce an improved method in the manufacture of an elevator and an improved construction-time elevator arrangement. With the solution according to the invention, it is possible to directly or indirectly affect numerous problems of jump-lifts. Some embodiments, inter alia, are disclosed with which it is possible to, inter alia, reduce the weight to be hoisted in lifting the supporting structure. Some embodiments, inter alia, are disclosed with which it is possible to affect the center of mass of the structure lifting the supporting structure, more particularly to displace the center of mass to close to the center point of the supporting structure.

In the method according to the invention in the manufacture of an elevator an elevator arrangement is formed, which comprises an elevator hoistway, at least one elevator unit to be moved in the elevator hoistway, said unit(s) including at least an elevator car, a movable supporting structure in the elevator hoistway above the elevator car and roping suspended from the supporting structure and preferably traveling over a rope pulley supported on the supporting structure for supporting the aforementioned at least one elevator unit to be moved. In the method these phases are performed:

a) the elevator car is used to transport passengers and/or freight, after which
b) the supporting structure is lifted higher up in the elevator hoistway, thus changing the service range of the elevator car to reach higher up in the elevator hoistway, after which
c) the elevator car is again used to transport passengers and/or freight.

In the method, between phase a and c, preferably between phase a and b, a phase x additionally is performed, in which the section of the roping is lifted, separately from the lifting of the supporting structure, higher up in the elevator hoistway. This achieves, among other things, less weight than before needing to be lifted at one time in lifting the support structure.

Preferably during the lift of phase x the support structure is stationary in its position in the vertical direction. In this way the lift is safe, as the amount of moving weight and parts remains small. On the other hand, among other things, the same hoisting device can in this way be used for the lifts of phase b and x, if so desired.

Preferably in phase x the section of the roping is lifted and the section is supported higher up in the elevator hoistway. Preferably in phase x the section of roping is supported to be suspended in the elevator hoistway from a structure that is separate from the supporting structure, which is preferably higher than the supporting structure. In this way an essential part of the roping can be kept away from the support of the supporting structure during the other phases.

Preferably before phase b phase a' is performed, in which the elevator car is removed from the aforementioned use, and after phase b phase b' is performed, in which the elevator car is taken back into the aforementioned use. The elevator car is thus out of use during the lifting of the supporting structure, as it also is during the lifting of the aforementioned section, because phase x is preferably performed between phase a' and b'.

Preferably a cycle comprising the aforementioned phases a, b and c is performed more than once and some of the cycles or all of the cycles comprise the aforementioned phase x. Thus with a number of lifts of the supporting structure the service range of the elevator car can be changed to reach higher up in the elevator hoistway, taking the elevator car into use between the lifts. By the aid of phase x, the weight to be lifted can be lightened. When the supporting structure is still in the lower parts of the hoistway it is not necessary to perform phase x in a cycle.

Preferably the aforementioned structure separate from the supporting structure is a rope pulley, over which the aforementioned section travels, and which rope pulley is preferably above the supporting structure. The advantage is that the rope pulley can transmit support reaction to the rope simply without gripping. Likewise the rope pulley can guide the roping to travel in the desired direction. The fixing point of the roping can be freely selected from elsewhere, e.g. from the supporting structure.

Preferably in phase x the aforementioned section is lifted higher up in the elevator hoistway by pulling it upwards, preferably by lifting the rope pulley over which the aforementioned section travels. By the aid of the rope pulley the roping can be simply lifted, exerting the lifting force on a point between the ends of it. Thus it is not necessary to grip the rope and the rope lengths can, when lifting the rope pulley, automatically match on both sides of the rope pulley.

Preferably the roping on the first side of the rope pulley travels downwards to an elevator unit and the roping on the second side of the rope pulley travels to the supporting structure, and is fixed to it at least during phase c. This has been implemented in such a way that at least during phase c the weight of the part of the roping hanging on the first side of the rope pulley of the roping pulls the part of the roping hanging on the second side of the rope pulley, and thus the supporting structure, upwards. In this way the roping can lighten the weight of phase b to be lifted.

Preferably in phase x the rope pulley is supported on a guide rail of a moving elevator unit of the elevator, preferably on a guide rail of the counterweight. In this case the weight of the aforementioned section stays away from the support of the guide rails of the elevator car. Preferably in phase b the supporting structure is lifted with a hoisting arrangement, which takes the vertical support reaction needed for the lift from the guide rails of the elevator car and/or the supporting structure is arranged to be supported during the aforementioned use by the guide rails of the elevator car. In this way the load can be divided between the guide rails of the elevator car and the guide rails of the counterweight, and bending of the guide rail lines caused by overloading can be avoided.

Preferably the roping is arranged to hang in the vertical direction in the elevator hoistway, and in phase x the lifting force is exerted the top part of the roping, preferably on the apex of the aforementioned section, which apex is in the proximity of the supporting structure and/or above the supporting structure.

Preferably the roping comprises a first end and a second end, and the aforementioned section to be lifted separately is the section of roping between the first end and the second end, preferably at a distance from the aforementioned ends.

Preferably the elevator is formed to comprise a first elevator unit to be moved and a second elevator unit, which first elevator unit is an elevator car and which second elevator unit is a counterweight, or vice versa. Preferably the elevator is formed to comprise roping traveling over a rope pulley supported on the supporting structure, the roping on the first side of the rope pulley of which supporting structure supports a first elevator unit and is supported on a first rope clamp, and the roping on the second side of the aforementioned rope pulley supports a second elevator unit and is supported on a second rope clamp.

Preferably in phase x lifting force is exerted on point x of the section of roping, which point x is between the rope clamps. In this way the length of the roping between the rope clamps can be lengthened. The aforementioned section to be lifted can thus be simply pulled upwards as a loop.

Preferably the roping is connected to at least a second elevator unit via a rope pulley, to travel from the rope pulley of the supporting structure downwards to a diverting pulley connected to the second elevator unit, under said diverting pulley and back upwards to the rope clamp (9), and in phase x lifting force is exerted on point x of the section of roping, which point x is between the aforementioned diverting pulley of the second elevator unit and the rope clamp (9) and the rope section in question is supported to be suspended in the elevator hoistway from the diverting pulley that is higher than the supporting structure and separate from the supporting structure. Preferably the rope clamp 9 is supported on the supporting structure and during phase b the rope clamp is kept closed. Preferably during the lifting of the rope section the rope clamp (9) is open. Preferably during the aforementioned use the rope clamp (9) is closed.

Preferably the aforementioned structure separate from the supporting structure is stationary in position during phase b, preferably supported on the elevator hoistway, preferably on a guide rail of the elevator, most preferably on a guide rail of the counterweight. In this way a small number of parts move at one time in the hoistway. When the aforementioned structure is supported on a guide rail of the counterweight, it and the ropes hanging from it can be simply kept aside from the other parts of the supporting structure that are to be lifted. Another advantage is that the lift of phase b can in this case be performed while supported on the guide rails of the elevator car and/or the supporting structure can be supported after phase b on the guide rails of the elevator car, so that at any one time the loads are simultaneously supported by different structures.

Preferably for lifting the aforementioned rope section, rope is released from the rope storage, to which the roping travels via an openable rope clamp.

The elevator arrangement according to the invention comprises an elevator hoistway, at least one elevator unit to be moved in the elevator hoistway, said unit(s) including at least an elevator car, a movable supporting structure in the elevator hoistway above the elevator car and roping hanging from the supporting structure, and preferably traveling over a rope pulley supported on the supporting structure, for supporting the aforementioned at least one elevator unit to be moved. The elevator arrangement further comprises, separate from the supporting structure, a structure supported by which a section of the roping is arranged to be suspended. In this way the weight hanging from the supporting structure can be lightened.

Preferably the structure separate from the supporting structure is a movable structure. In this way the section of roping can be lifted separately from the supporting structure by displacing the aforementioned structure that is separate from the supporting structure, and thus the weight to be moved in the lifting of the supporting structure is lightened.

Preferably the aforementioned structure separate from the supporting structure is a rope pulley, over which the roping travels.

Preferably the roping on the first side of the rope pulley travels downwards to an elevator unit and the roping on the second side of the rope pulley travels down to rope clamp (9) in connection with the supporting structure. In this way the roping, while being supported on the rope pulley that is separate from the support structure, can pull the supporting structure upwards, thus lightening the weight to be lifted in phase b. Preferably the rope clamp fixes the roping to the supporting structure or can be brought into this type of state, and the arrangement is configured/can be configured in such a way that the weight of the part of the roping hanging on the first side of the rope pulley pulls the part of the roping hanging on the second side of the rope pulley, and thus the supporting structure, upwards.

Preferably the elevator arrangement comprises a hoisting arrangement, which is arranged to lift the aforementioned section separately from the supporting platform.

Preferably the elevator arrangement comprises a hoisting arrangement, which is arranged to lift the aforementioned structure that is separate from the supporting structure separately from the supporting platform.

Preferably the supporting structure comprises means for the vertical support of the supporting structure in its position in the elevator hoistway, which means can be moved between a state supporting the supporting structure in its position in the vertical direction and a state not supporting it in its position in the vertical direction.

Preferably only vertical forces are exerted on the guide rails of the elevator, which improves the bearing capacity of the guide rails.

The elevator is most preferably an elevator applicable to the transporting of people and/or of freight, which elevator is installed in a building, inside the cross-section of the building, to travel in a vertical direction, or at least in an essentially vertical direction, preferably on the basis of landing calls and/or car calls. The elevator car preferably has an interior space, which is most preferably suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein FIG. 1*a* diagrammatically presents an elevator arrangement, when the elevator car is in use to serve passengers and/or to transport freight.

DETAILED DESCRIPTION OF THE INVENTION

Figure 1A:
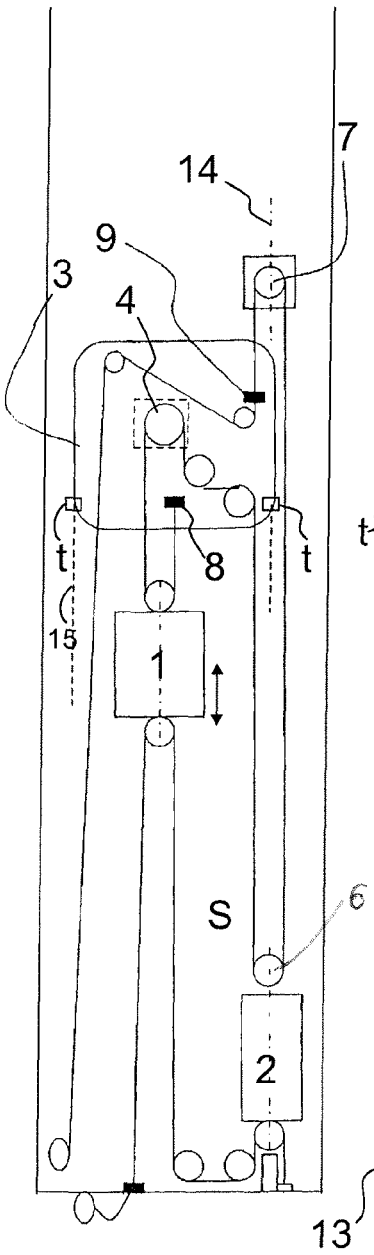
FIG. 1*b* diagrammatically presents an elevator arrangement, when the elevator car is removed from the aforementioned use and the section of roping is lifted.
FIG. 1*c* diagrammatically presents an elevator arrangement, when the elevator car is removed from the aforementioned use and the supporting platform supporting it is lifted higher up in the elevator hoistway for changing the service range of the elevator car to reach higher up in the elevator hoistway.
Figure 1B:
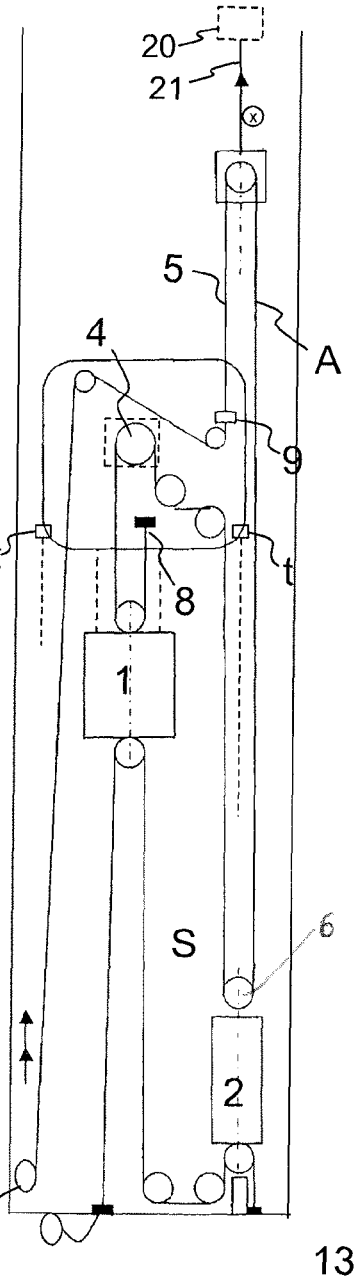
Figure 1C:
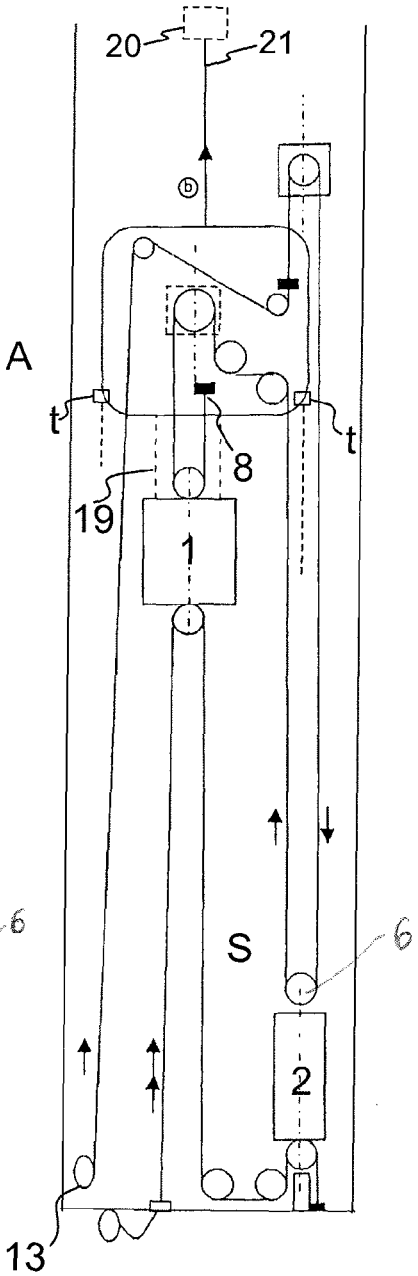

FIGS. 1*a*-1*c* present a first embodiment of the invention in different phases. FIG. 1*a* presents an elevator arrangement according to the invention, which arrangement is achieved by performing the phases of the method according to the invention in the manufacture of the elevator. An elevator arrangement is formed, which comprises an elevator hoistway, elevator units (1 and 2), inter alia an elevator car 1, to be moved in the elevator hoistway, a movable supporting structure 3 in the elevator hoistway above the elevator car 1 and roping 5 suspended from the supporting structure 3 and traveling over a rope pulley 4 supported on the supporting structure 3 for supporting the aforementioned at least one elevator unit to be moved. In the method the elevator car (1) is used (phase a) to transport passengers and/or freight, in which case the elevator car 1 moves in the elevator hoistway S between floor landings. Meanwhile the elevator hoistway S, or the elevator otherwise, can be constructed above the supporting structure 3, e.g. above the supporting structure the guide rails 15 of the elevator can be installed by stacking the guide rails as an extension of the guide rail line, guided by which guide rail line the elevator car 1 below the supporting structure 3 travels. After this the elevator car 1 is removed from the aforementioned use. FIG. 1*b* presents a phase of the method, in which the elevator car 1 is removed from the aforementioned use. After removal of the elevator car 1 from use, the section A of the roping 5 is lifted (phase x) higher up in the elevator hoistway S when the supporting structure 3 is stationary in its vertical position, preferably supported in its position by the aid of the means t or alternatively other means (e.g. a hoisting device). After this the supporting structure 3 is lifted higher up in the elevator hoistway S (phase b). Thus the service range of the elevator car 1 is changed to reach higher up in the elevator hoistway S. In phase x, therefore, the section (A, A', A") of the roping 5 is lifted, separately from the lifting of the supporting structure 3 (phase b), which means that two lifting procedures are performed. Preferably the lifts b and x occur one after the other, in which case preferably the same hoisting apparatus (e.g. a hoist 20 and a hoisting means 21) are utilized in the lifts x and b. If the need arises, the lifts could however be performed simultaneously, e.g. by the aid of two hoisting arrangements. In the solution presented, at least a section of the roping 5 suspended from the supporting structure 3 rises along with in phase b. When the supporting structure 3 has been lifted (phase b) and phase x has been performed, the elevator car 1 is taken back into the aforementioned use and the elevator car 1 is again used to transport passengers and/or freight (phase c). In phase x the section A of roping 5 is preferably supported to be suspended in the elevator hoistway S from the structure (7, 7', 7") that is separate from the supporting structure 3. In this way at least an essential part of the weight of the rope section A is supported separately from the supporting structure 3 at least during the lifting of the supporting structure 3. The aforementioned structure that is separate from the supporting structure is preferably after phase x higher up than the supporting structure 3, in which case in phase b subsequent to phase x the supporting structure can be lifted closer to the support of the section A. With separate lifts of the section A of the roping 5 and of the supporting structure, the weight that needs to be lifted at one time in the lifting of the supporting structure 3 is less than before. In the method the phase cycle a, b, c can be performed more than once, in which case with a plurality of lifts the service range of the elevator car can be brought to reach to the desired height. Not all of the cycles must necessarily comprise a phase x, because the lifting height of phase x can be greater than the lifting height of phase b, in which case it can if necessary be omitted from some of the cycles. Phase x is performed before phase b, but advantages can also be achieved if these two phases are performed in the reverse sequence, with the method remaining the same in other respects.

The supporting structure 3 is movable, i.e. the elevator arrangement (most preferably the supporting structure 3 itself, as is presented in the figures) comprises means t for the vertical support of the supporting structure 3 in its position in the elevator hoistway S, which means can be moved between a state supporting the supporting structure 3 in its position in the vertical direction and a state not supporting it in its position in the vertical direction. This can be implemented in some manner according to prior art. In the state supporting the supporting platform 3 in its position they can e.g. rest (in the vertical direction) preferably supported by the guide rails 15 comprised in the elevator (the guide rails 15 of the elevator car 1 are marked in FIG. 1 by way of reference, and for the sake of clarity with a dashed line). Thus after the lifting of the supporting structure 3, the supporting structure 3 is arranged to be supported in its position in the elevator hoistway S by locking it to be supported in the vertical direction by the guide rails 15. Alternatively the means t can support the supporting structure 3 in its position in the supporting state (in the vertical direction) resting on some other structure installed in the elevator hoistway or on a structure of the elevator hoistway itself. In the aforementioned state not supporting it in position the means t do not hamper the vertical transfer of the supporting platform in the hoistway. The means t can be grippers to be manually tightened to the guide rails, or they can be means movable between an extended and retracted position in the lateral direction, as are known in the art.

Figure 4:
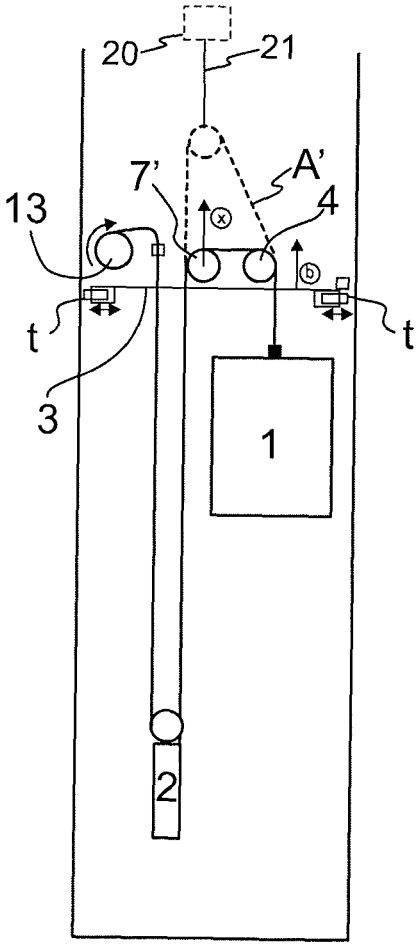
FIG. 4 presents an arrangement according to a second embodiment of the invention, in which the method is performed.
Figure 5:
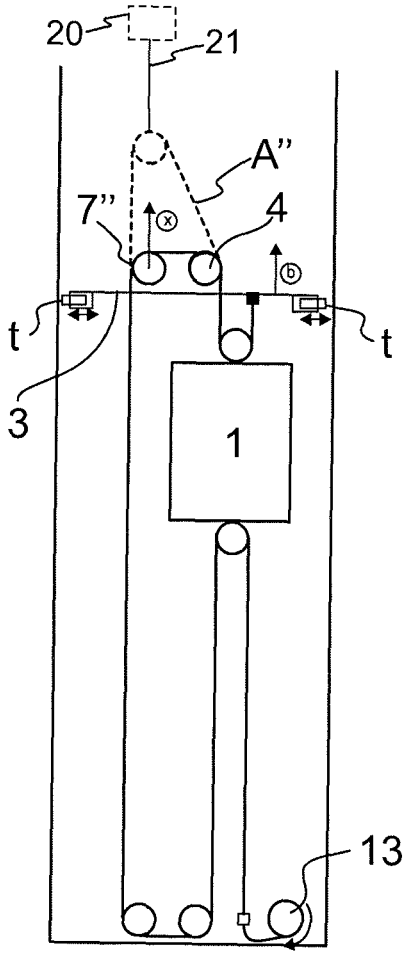
FIG. 5 presents an arrangement according to a third embodiment of the invention, in which the method is performed in an elevator without counterweight.

The matters presented above are implemented, in addition to FIGS. 1*a*-1*c*, also in the case of the second embodiment presented in FIG. 4 and in the third embodiment presented in FIG. 5, although the embodiments in question are described with only one figure.

As presented in FIGS. 1*a*-1*c*, the elevator arrangement is preferably such that the aforementioned roping 5 hangs from the supporting structure 3, functioning as suspension roping, hanging preferably supported by a rope pulley system supported on the supporting structure 3, the rope pulley 4 of which rope pulley system can be the traction sheave of the hoisting machine. The roping 5 is, in the solution presented, connected to the elevator car 1 and to the counterweight 2 such that when the elevator car moves upwards, the counterweight moves downwards, and vice versa. The elevator arrangement further comprises roping 5 traveling over a rope pulley 4 supported on the supporting structure 3, the roping 5 on the first side of the rope pulley 4 of which supporting structure 3 supports a first elevator unit 1 and is supported on a first rope clamp 8, and the roping 5 on the second side of the aforementioned rope pulley 4 supports a second elevator unit 2 and is supported on a second rope clamp 9.

Preferably, as presented in the figures, the roping 5 is connected to at least the second elevator unit 2 via the rope pulley 6, to travel from the rope pulley 4 of the supporting structure downwards to the diverting pulley 6 connected to the second elevator unit 2, under it and back upwards to the rope clamp 9. In phase x the rope section A between the aforementioned diverting pulley 6 of the second elevator unit 2 and the rope clamp 9 is lifted in the elevator hoistway S and the rope section A in question is supported to be suspended in the elevator hoistway S from a structure 7, which is preferably a diverting pulley, that is higher than the supporting structure 3 and separate from the supporting structure 3. In this way at least an essential part of the weight of the rope section A is supported by the structure 7 that is separate from the supporting structure 3. In phase x the section A is lifted higher up in the elevator hoistway S by pulling it upwards, preferably by lifting the structure 7 in question, i.e. here the rope pulley 7, over which the section A travels. The structure 7 is for this purpose preferably movable, i.e. detachably supported/supportable in its position. In this case the structure can be e.g. in its position with a bolt fastening. One advantage, among others, of a rope pulley being the structure 7 is that the rope lengths match simply and the lifting force can be simply exerted on a point between the ends of the roping. Preferably the rope pulley 7 is supported in phase x on a guide rail of a moving elevator unit of the elevator, more particularly as an extension of the guide rail line, guided by which guide rail line the elevator car 1 below the supporting structure 3 is configured to travel. The roping 5 is preferably arranged to hang in the vertical direction in the elevator hoistway, and in phase x the lifting force is exerted on the top part of the roping 5, preferably on the apex of the aforementioned section A, which apex is higher than the supporting structure 3. Preferably the lifting force is exerted on a point of the section A of the roping 5, which point is between the rope clamps 8,9. The rope pulley 7 is preferably during phase x stationary in its position, preferably supported in its position, preferably on a guide rail 14 of the counterweight. One advantage, among others, is that in this case the section of roping 5 stays away from the support of the guide rails of the elevator car. The arrangement is left as a conclusion to phase x preferably in a configuration wherein the roping 5 on the first side of the rope pulley 7 travels down to the elevator unit 2 and the roping 5 on the second side of the rope pulley 7 travels to the supporting structure 3, and is fixed to it/has been fixed to it at least during phase b. This is implemented in such a way that at least during phase b the weight of the part of the roping hanging on the first side of the rope pulley of the roping pulls the part of the roping hanging on the second side of the rope pulley 7, and thus the supporting structure 3, upwards. In this way the force needed for a lift to be performed later in phase/phases b is appreciably reduced. In practice this can be implemented e.g. as presented, such that the roping 5 on the second side of the rope pulley 7 travels to the supporting structure 3, to a rope clamp 9, which is supported on the supporting structure 3, which rope clamp 9 at least during phase b is kept closed. Also during the aforementioned use the rope clamp 9 is closed, as is also the rope clamp 8

Preferably the rope going from the car to the counterweight and the rope coming from the diverting pulley 7 are on the same vertical line. In this way e.g. in a sudden stop of the elevator (car grips or drives onto a buffer) the counterweight jumps up and comes down, in which case an impact load is exerted on the structure via the ropes of the counterweight. Owing to the system the same force is exerted on the supporting structure both upwards and downwards, thus cancelling each other out.

The roping 5 comprises a first end and a second end, and the aforementioned section A is the section of roping 5 between the first end and the second end. At least one of the ends is in the rope supply storage, to which the rope travels via a rope clamp. For lifting the aforementioned rope section A rope is released from the rope storage, to which the roping rising from the rope pulley 7 of the second elevator unit travels via a rope clamp 9.

The actual lifting of the support structure 3 can be performed e.g. in some manner known in the art. Preferably before the lifting of the supporting structure 3, a support arrangement is supported on the top ends of the guide rails of the elevator car 1, which top ends extend to essentially above the supporting platform 3. At the latest after this the elevator car 1 is removed from the aforementioned use. After this the supporting platform 3 is taken onto the support of the hoisting arrangement 20,21 and the rope clamp 9 and/or 8 is released, and the vertical support of the supporting platform 3 is released, i.e. the means t are shifted into the state not supporting the supporting platform 3 in its position in the vertical direction. In the lifting the supporting platform 3 is pulled with a hoist 20 to higher up in the elevator hoistway 1, preferably taking the vertical support force needed for the lifting from the guide rails with the support arrangement on which the hoist 20 (not presented) is supported. Preferably at least most, preferably essentially all, the vertical support force needed for the lift is taken from the aforementioned guide rails. After being taken out of use the elevator car 1 can preferably be supported on the supporting platform 3 via a suspension member 19, in which case it rises along with the supporting platform 3. This is not however necessary, but instead the car 1 could also be stationary in its position during the lift. During the lifting of the supporting platform, rope is released from the rope storage 13 of the roping 5. When the supporting platform 3 has been lifted to its target height, the means t are shifted into the state supporting the supporting platform 3 in its position in the vertical direction, the rope clamps 8, 9 are fixed, and the elevator car 1 is taken back into the aforementioned use.

Figure 2:
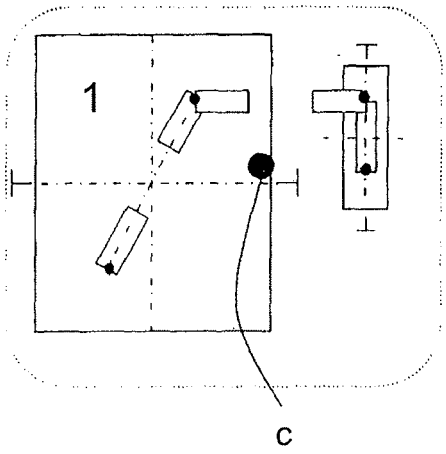
Fig. 2 PRIOR ART
FIG. 2 presents a top view of the location of the center of mass when the supporting structure is lifted with a method according to prior art.
Figure 3:
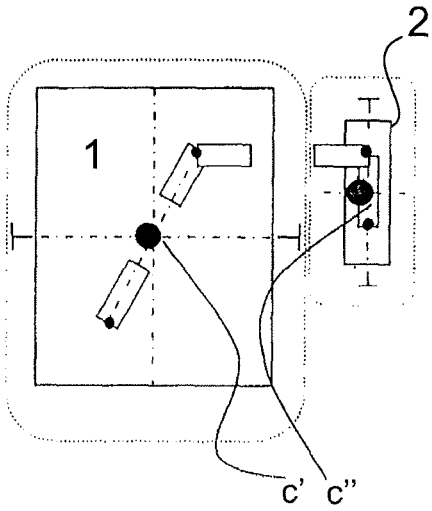
FIG. 3 presents a top view of how with the method and the arrangement according to the invention the location of the center of mass of the supporting structure can be configured to be more advantageous than before.

FIGS. 2 and 3 illustrate one advantage of the invention, namely the freer selection than before of the location of the center of mass during the lift. FIG. 2 presents the center of mass c of the supporting structure during a lift in a case according to prior art, wherein all the roping, including the ropes on the counterweight side, hang during the lift from one supporting structure alone. The center of mass is aside from the center point of the elevator car. FIG. 3 presents the location of the centers of mass c' and c". The center of mass c' is the center of mass during the lifting of the supporting structure and c" is the center of mass of the structure 7. By the aid of the structure 7 the center of mass of the supporting structure can be displaced, e.g. to the center point of the elevator car.

The method according to the invention can be used in different types of elevators. FIG. 5 illustrates how the method can be utilized in an elevator without counterweight. Likewise the lifting force in phase x can be exerted on a section of roping 5, which is other than a section of roping running from an elevator unit to a rope clamp, as is illustrated in FIGS. 4 and 5. In the solutions in question, the rope pulley 7', 7", over which the section A', A" of roping between the elevator units 1 and 2 travels and which is otherwise supported on the supporting structure 3, is lifted and thus roping 5 is pulled from the rope supply storage 13. After this the supporting platform 3 is lifted, during which time the rope pulley 7', 7" is supported separately from the supporting platform, e.g. supported on the counterweight guide rails (not presented).

Compensating roping has also been drawn in FIGS. 1*a*-1*c*, the presence of which is not essential from the viewpoint of the operation of the invention. In the figures, a shaded rope clamp describes a rope clamp in the closed position and unshaded a rope clamp in the open position.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A method in the manufacture of an elevator, in which is formed an elevator arrangement, the elevator comprising:

an elevator hoistway, a first elevator unit to be moved in the elevator hoistway, said first elevator unit including at least an elevator car, a movable supporting structure in the elevator hoistway above the elevator car, roping suspended from the supporting structure for supporting the first elevator unit to be moved, said method comprising the steps of:

a) using the elevator car to transport passengers or freight;

b) after step a), lifting the supporting structure in the elevator hoistway; and c) after step b), using the elevator car to transport passengers or freight, wherein in the method between steps a) and b), a step x) is performed, the step x) comprising lifting a section of the roping separately from the lifting of the supporting structure higher up in the elevator hoistway, the section of the roping being supported by a structure separate from the supporting structure and positioned higher than the supporting structure in the elevator hoistway, wherein the roping passes the structure, travelling, on a first side of the structure, to suspend the elevator car, and travelling, on a second side, opposite to the first side, of the structure, to the supporting structure, and the roping, on the second side of the structure, is fixed to the supporting structure during the step b), wherein the elevator further comprises a second elevator unit to be moved in the elevator hoistway, and in the step x), the structure that is separate from the supporting structure is movably supported on a guide rail of the second elevator unit wherein the second elevator unit is a counterweight, and wherein the roping on the first side of the structure travels to suspend the elevator car by passing through a roping pulley attached to a top of the second elevator unit, and the roping on the second side of the structure travels to the supporting structure and then to a roping storage, the roping storage releasing roping during the step x) and the step b).

2. The method according to claim 1, wherein a cycle comprising the steps a), b) and c) is performed more than once, and some of the cycles or all of the cycles comprise the step x).

3. The method according to claim 2, wherein during step x), the support structure is stationary in its position in the vertical direction.

4. The method according to claim 2, wherein in step x), the section of the roping is lifted and is supported higher in the elevator hoistway.

5. The method according to claim 1, wherein during the step x), the support structure is stationary in its position in the vertical direction.

6. The method according to claim 1, wherein in the step x), the section or the roping is lifted and supported higher in the elevator hoistway.

7. The method according to claim 1, wherein the structure separate from the supporting structure is a rope pulley.

8. The method according to claim 1, wherein in the step x), the section is lifted higher up in the elevator hoistway by being pulled upwards, by lifting the structure over where the section travels.

9. The method according to claim 1, wherein the structure separate from the supporting structure is during step b) stationary in its position, supported in the elevator hoistway, on the guide rail of the counterweight.

10. The method according to claim 1, wherein for lifting the rope section, rope is released from a rope storage, to which the roping travels via an openable rope clamp.

11. The method according to claim 1, wherein in the step x), the section is lifted higher up in the elevator hoistway by being pulled upwards.

12. The method according to claim 1, wherein the structure separate from the supporting structure is during step b) stationary in its position.

13. The method according to claim 1, wherein the roping on the first side of the structure is stationary with regard to the roping pulley attached to the top of the second elevator unit during the step x), and is moving with regard to the roping pulley attached to the top of the second elevator unit during the step b).

* * * * *